United States Patent [19]

Dandl

[11] 4,189,660

[45] Feb. 19, 1980

[54] ELECTRON BEAM COLLECTOR FOR A MICROWAVE POWER TUBE

[75] Inventor: Raphael A. Dandl, Oak Ridge, Tenn.

[73] Assignee: The United States of America as represented by the United States Department of Energy, Washington, D.C.

[21] Appl. No.: 961,175

[22] Filed: Nov. 16, 1978

[51] Int. Cl.[2] ..... H01J 23/02

[52] U.S. Cl. ..... 315/5.38; 315/3; 315/4; 315/5; 315/5.24; 315/39; 333/227

[58] Field of Search ..... 315/3, 4, , 5, 5.38, 5.39, 315/5.24, 5.25, 39; 333/227

[56] References Cited

U.S. PATENT DOCUMENTS

| | | | |
|---|---|---|---|
| 3,267,383 | 8/1966 | Lohmann | 315/4 X |
| 3,316,511 | 4/1967 | Schulten | 333/227 |
| 3,489,944 | 1/1970 | Denholm et al. | 315/5.39 |
| 3,700,952 | 10/1972 | Nation | 315/5.39 |
| 3,885,193 | 5/1975 | Budker et al. | 315/5.24 |
| 3,936,695 | 2/1976 | Schmidt | 315/5.38 |
| 4,019,088 | 4/1977 | Budker et al. | 315/5.25 |
| 4,068,146 | 1/1978 | McKeown et al. | 315/5.24 |
| 4,122,372 | 10/1978 | Walsh | 315/5 |

*Primary Examiner*—Saxfield Chatmon, Jr.
*Attorney, Agent, or Firm*—R. V. Lupo; Stephen D. Hamel; Louis M. Deckelmann

[57] ABSTRACT

This invention relates to a cylindrical, electron beam collector that efficiently couples the microwave energy out of a high power microwave source while stopping the attendant electron beam. The interior end walls of the collector are a pair of facing parabolic mirrors and the microwave energy from an input horn is radiated between the two mirrors and reassembled at the entrance to the output waveguide where the transmitted mode is reconstructed. The mode transmission through the collector of the present invention has an efficiency of at least 94%.

2 Claims, 1 Drawing Figure

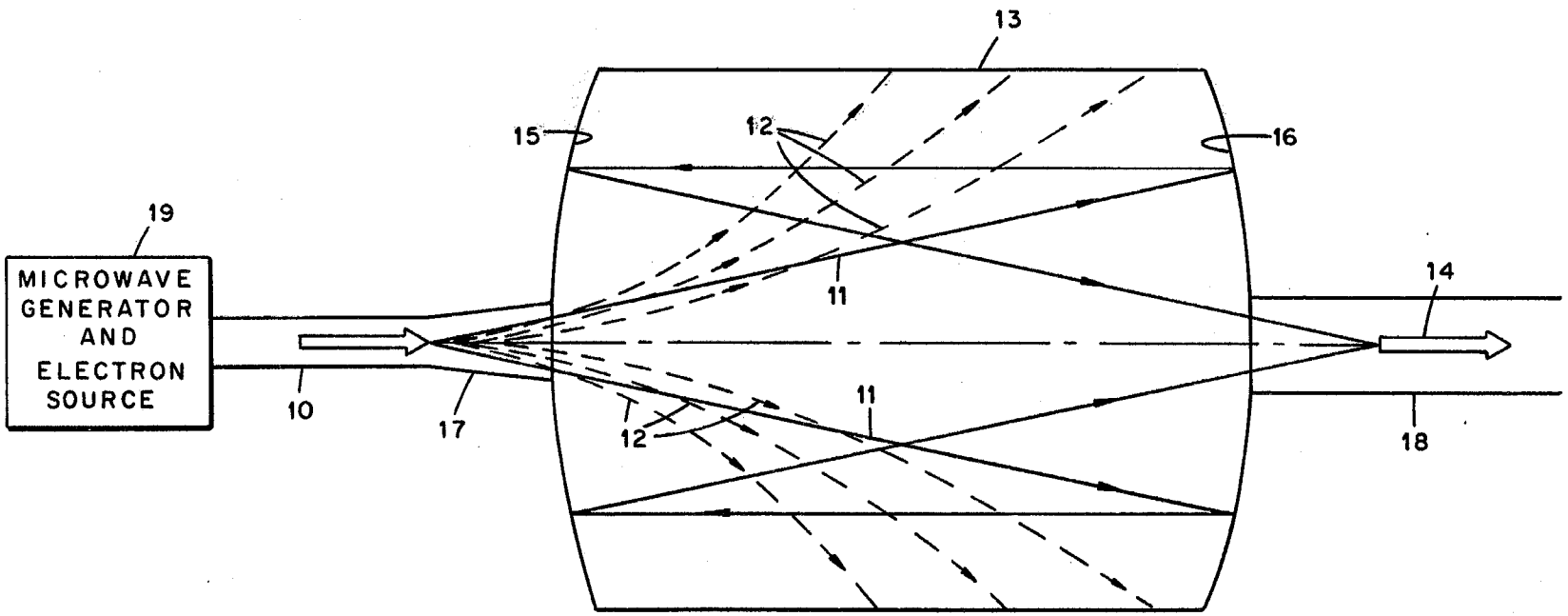
14
18
16
13
11
11
12
12
15
17
10
19
MICROWAVE GENERATOR AND ELECTRON SOURCE

ELECTRON BEAM COLLECTOR FOR A MICROWAVE POWER TUBE

BACKGROUND OF THE INVENTION

This invention was made in the course of, or under, a contract with the U.S. Department of Energy.

A high power continuous wave (cw) microwave generator is based upon the cyclotron resonance interaction between an electron beam and microwave fields. When a continuous wave device is operated at very high power levels, a large-area water-cooled collector is required to dissipate the electron beam power. A large collector area is usually obtained by gradually increasing (tapering) the cylindrical collector to a large diameter. While this solves the electron beam dissipation problem, it creates difficulties in the R.F. power component because the expanded collector wall must be tapered down again to match the diameter of the output waveguide, and a portion of the R.F. power is converted into higher-order electro-magnetic modes which do not propagate into the output waveguide but remain trapped in the collector. Dissipative resonances of these trapped modes thus limit the microwave power output.

A recent advance by Varian Associates utilizes a miter elbow which incorporates a 45° reflecting surface for diverting the R.F. energy at an angle of 90° to the focused electron beam thereby allowing the R.F. energy to substantially bypass the electron beam collector region of the device. The reflecting surface is only quasi-optical, however, having a hole through its center that allows the focused electron beam to pass through the reflecting surface into the collector region. However, the above advance is not a completely satisfactory solution to the above problem in that reflections take place in the miter elbow that cause marginal efficiency in allowing a large fraction of the microwave power to be coupled out of the generator. Spurious modes are generated that reflect back into the electron gun region, and some of the microwave power passes through the electron beam hole in the reflecting surface of the elbow where it becomes trapped in the electron beam collector. Thus, there exists a need to provide for a more efficient means of power coupling for a high power continuous wave microwave generator that not only stops the attendant electron beam but at the same time substantially improves the microwave power output. The present invention was conceived to meet this need in a manner to be described hereinbelow.

SUMMARY OF THE INVENTION

It is the object of the present invention to provide an improved electron beam collector for a microwave power tube that efficiently couples the microwave energy out of a high power microwave source while stopping the attendant electron beam.

The above object has been accomplished in the present invention by providing a cylindrical electron beam collector with the interior end walls thereof being made in the form of a pair of facing parabolic mirrors. An oversized circular waveguide couples an electron beam and the microwave power from a microwave generator into the beam collector. The electrons from the electron beam spread out in the collector and are dissipated in the collector walls in the usual way. The microwave energy coming into the collector from said waveguide is radiated therefrom out to the far mirror of the collector, reflected therefrom as parallel or near parallel rays back to the rear mirror of the collector that surrounds the waveguide, again reflected, and then is focused and recombined at the entrance to an oversized output waveguide in the center of the far mirror, thus providing a substantial improvement in the microwave energy output from the collector over that possible in the prior art.

BRIEF DESCRIPTION OF THE DRAWING

The single FIGURE is a schematic illustration of the improved system of the present invention for achieving the above object.

DESCRIPTION OF THE PREFERRED EMBODIMENT

In the single FIGURE, a cylindrical electron beam collector (dump) 13 is provided with the interior end walls thereof being made in the form of a pair of parabolic mirrors 15, 16. A microwave generator which may be a gyrotron (oscillator) or a gyroklystron (amplifier) and operating at a 200 kw power level, for example, and a gyrotron electron source are combined in a unit 19. The gyrotron has been described in Radio Engineering and Electronic Physics, Vol. 19, No. 4, pp. 95–100, 1974, entitled: "An Experimental Study of a Gyrotron, Operating at the Second Harmonic of the Cyclotron Frequency, with Optimized Distribution of the High Frequency Field," by Kisel et al. The outputs from the unit 17 are fed by means of an oversized waveguide 10 and a horn 17 into the collector 13. It should be understood the collector 13 is provided with a plurality of cooling water lines, not shown, on the exterior thereof in a conventional manner.

As the electron beam leaves the strong magnetic field of the microwave generator proper, the electron paths, represented by the dotted lines 12 in the collector 13, spread out as they follow the expanding magnetic field lines and the electrons are dissipated in the collector 13 walls in the usual way.

The microwave energy, on the other hand as represented by the solid line rays 11, is radiated from the horn 17 out to the far mirror 16, reflected as parallel or near parallel rays back to the rear mirror 15 that surrounds the horn 17, and then are reflected, focused and recombined as at 14 at the entrance to an oversized output waveguide 18, as illustrated in the FIGURE. Since the wavefronts are recombined, symmetry is preserved, and the transmitted mode(s) is reconstructed in the output waveguide 18, thus substantially preventing the conversion of a portion of the R.F. power into higher-order electro-magnetic modes within the electron beam collector which was a problem in the prior art as discussed above.

In a test of the above-described device for the $TE^{\circ}_{1}$ mode using 12-inch diameter spherical mirrors with a 2.5-inch diameter output waveguide, the optimum entrance diameter into the collector was found to be 2.5 inches for a 16-inch mirror separation. The maximum $TE^{\circ}_{1}$ mode transmission observed was 94%.

The advantages of the above-described device are as follows:

1. Improved efficiency—A microwave power generator that employs the above-referenced miter elbow has been observed to be 50–60% efficient. The observed 94% efficiency provided by the present device represents a very large improvement in performance.

2. Fewer spurious modes—Related to the improved efficiency is the fact that since most of the microwave power is coupled out of the collector into the output waveguide, very little power is left in the system to cause difficulties in the generator. In the case of a collector utilizing the miter elbow advance, the substantial amount of microwave power that is not transmitted out of the generator radiates back into the electron gun region, heats the source, and causes cathode problems.

3. Preserved symmetry—In any microwave power device, preservation of the symmetry of the transmitted modes is usally an important consideration. Symmetry is preserved in the present device.

4. Simplicity—The present device only relates to the design of the collector and it does not complicate the generator design.

5. CW operation—The present device makes true continuous wave operation possible in what up to now have been only pulsed gyrotron or gyroklystron devices.

This invention has been described by way of illustration rather than by way of limitation and it should be apparent that it is equally applicable in fields other than those described.

What is claimed is:

1. An improved device for separating high power microwaves from a high power electron beam comprising a cylindrical electron beam collector with the interior back and front end walls thereof being made in the form of a pair of facing parabolic mirrors; a microwave generator and an electron source, a series connected waveguide and horn coupled between said microwave generator-electron source and said collector through the central portion of the back mirrored end wall of said collector; and an output waveguide coupled to the central portion of the front mirrored end wall of said collector, whereby during operation of said device, the electrons entering said collector spread out and are dissipated in the cylindrical wall of said collector and the microwave energy entering said collector in the form of rays is reflected from the front mirrored end wall to the back mirrored end wall of the collector where said rays are again reflected and are focused and recombined at the entrance to said output waveguide thereby providing an efficient reconstruction of the transmitted mode of the microwave energy in the output waveguide to provide a transmission efficiency of the microwave energy through said collector of at least 94%.

2. The device set forth in claim 1, wherein said microwave generator is a gyrotron.

* * * * *